US011452321B2

(12) United States Patent
Fitzgerald

(10) Patent No.: US 11,452,321 B2
(45) Date of Patent: Sep. 27, 2022

(54) GLOVE HAVING REINFORCED FINGERTIPS

(71) Applicant: Mechanix Wear LLC, Valencia, CA (US)

(72) Inventor: Thomas B. Fitzgerald, Simi Valley, CA (US)

(73) Assignee: Mechanix Wear LLC, Valencia, CA (US)

( * ) Notice: Subject to any disclaimer, the term of this patent is extended or adjusted under 35 U.S.C. 154(b) by 0 days.

(21) Appl. No.: 16/136,582

(22) Filed: Sep. 20, 2018

(65) Prior Publication Data

US 2019/0246714 A1 Aug. 15, 2019

Related U.S. Application Data

(63) Continuation of application No. 14/853,828, filed on Sep. 14, 2015, now Pat. No. 10,085,498.

(60) Provisional application No. 62/050,600, filed on Sep. 15, 2014.

(51) Int. Cl.
*A41D 19/00* (2006.01)
*A41D 19/015* (2006.01)

(52) U.S. Cl.
CPC ... *A41D 19/0006* (2013.01); *A41D 19/01505* (2013.01)

(58) Field of Classification Search
CPC ..... A41D 19/0006; A41D 19/01505
USPC ..... 2/161.1, 161.6, 163
See application file for complete search history.

(56) References Cited

U.S. PATENT DOCUMENTS

| | | | | | |
|---|---|---|---|---|---|
| 745,088 | A | * | 11/1903 | Winkler | A41D 2/163 |
| 2,025,357 | A | | 12/1935 | Pagan | |
| 2,083,935 | A | * | 6/1937 | Georgietta | A41D 19/01529 2/161.6 |
| 3,348,238 | A | | 10/1967 | Hydock | |
| 3,597,765 | A | | 8/1971 | Stanton | |
| 3,605,117 | A | | 9/1971 | Latina | |
| 3,882,548 | A | | 5/1975 | Shinagawa et al. | |
| 3,918,096 | A | | 11/1975 | Lim | |
| 4,094,014 | A | * | 6/1978 | Schroeder | A41D 19/01505 2/161.8 |
| D248,898 | S | | 8/1978 | Deleone et al. | |
| D268,968 | S | | 5/1983 | Sami | |
| 4,484,359 | A | | 11/1984 | Tirinen | |
| 4,525,877 | A | * | 7/1985 | Chong | A63B 71/148 2/161.1 |
| 4,570,269 | A | | 2/1986 | Berlese | |

(Continued)

FOREIGN PATENT DOCUMENTS

KR 30-0416270 5/2006

OTHER PUBLICATIONS

Mechanix Glove Guide 2010, vol. 18; 13 pages.

(Continued)

*Primary Examiner* — Katherine M Moran
(74) *Attorney, Agent, or Firm* — K&L Gates LLP; Louis C. Cullman; Hal Gibson

(57) ABSTRACT

A glove has a segment secured to an inside surface of one or more finger and/or a thumb. The segment is fully contained within the distal most portions of the one or more finger and/or thumb and does not overlap with any knuckle of the user's finger. The segment doubles the layer of material of the glove in the pad region of the fingertip to improve wear length or wear resistance of the glove.

9 Claims, 2 Drawing Sheets

(56) References Cited

U.S. PATENT DOCUMENTS

| | | | | |
|---|---|---|---|---|
| 4,590,625 | A | 5/1986 | Keim | |
| D287,424 | S | 12/1986 | Berlese | |
| D288,981 | S | 3/1987 | Hale | |
| 4,751,749 | A | 6/1988 | Cowhey | |
| 4,768,234 | A | 9/1988 | Yamamoto | |
| 4,864,659 | A | 9/1989 | Morris | |
| 4,864,660 | A | 9/1989 | Sawyer | |
| 4,911,433 | A | 3/1990 | Walker et al. | |
| 4,930,162 | A | 6/1990 | Cote | |
| 5,067,175 | A | 11/1991 | Gold | |
| D328,369 | S | 7/1992 | Hong | |
| 5,423,089 | A | 6/1995 | Chun et al. | |
| 5,604,934 | A | 2/1997 | Willett | |
| 5,926,847 | A | 7/1999 | Eibert | |
| 5,983,395 | A * | 11/1999 | Lei | A41D 19/01558 2/159 |
| 6,185,747 | B1 | 2/2001 | Hughes | |
| 6,405,380 | B1 | 6/2002 | Kuroda et al. | |
| 6,415,445 | B1 | 7/2002 | Nishijima et al. | |
| D461,620 | S | 8/2002 | Bevier | |
| 6,732,377 | B1 | 5/2004 | Wilkinson | |
| D490,966 | S | 6/2004 | Sasaki | |
| D516,277 | S | 3/2006 | Mattesky | |
| 7,275,268 | B2 | 10/2007 | Gait | |
| 7,337,474 | B1 | 3/2008 | Godson | |
| D589,678 | S | 4/2009 | Lawrence | |
| D604,027 | S | 11/2009 | Kleinert | |
| D608,978 | S | 2/2010 | Votel | |
| D621,553 | S | 8/2010 | Fitzgerald et al. | |
| D625,051 | S | 10/2010 | Fitzgerald et al. | |
| D653,427 | S | 2/2012 | Wong | |
| 8,490,217 | B2 * | 7/2013 | Safford | A41D 19/01523 2/161.6 |
| 8,549,668 | B1 * | 10/2013 | Anderes, Jr | A41D 19/001 2/161.6 |
| D696,467 | S | 12/2013 | Nelson | |
| 8,935,812 | B2 | 1/2015 | Safford | |
| 9,622,525 | B2 | 4/2017 | Safford | |
| 2003/0051285 | A1 * | 3/2003 | Bower | A63B 71/141 2/16 |
| 2006/0195968 | A1 | 9/2006 | Powell et al. | |
| 2006/0212990 | A1 * | 9/2006 | Mattesky | A41D 19/0006 2/161.6 |
| 2007/0245453 | A1 * | 10/2007 | Dolenak | A41D 19/01529 2/161.6 |
| 2008/0263747 | A1 | 10/2008 | Deblasis et al. | |
| 2009/0229035 | A1 | 9/2009 | Van Hale | |
| 2010/0083420 | A1 | 4/2010 | Bouckaert | |
| 2010/0192279 | A1 | 8/2010 | Hunsicker | |
| 2011/0088139 | A1 | 4/2011 | Travell | |
| 2011/0107498 | A1 | 5/2011 | Chang | |
| 2011/0314588 | A1 * | 12/2011 | Gaskins | A41D 19/01547 2/160 |
| 2012/0017350 | A1 * | 1/2012 | McCrane | A63B 71/141 2/161.1 |
| 2013/0091613 | A1 * | 4/2013 | Meltzner | A41D 13/087 2/21 |
| 2018/0064186 | A1 | 3/2018 | Safford | |

OTHER PUBLICATIONS

Mechanix Wear "M-Pact Glove," as shown in NASCAR Illustrated magazine as of Apr. 1, 2012. Downloaded from the Internet on May 4, 2018.

Mechanix Wear "M-Pact Glove," as shown on-line at http://www.mechanix.com/m-pact-glove. Downloaded from the Internet on Jul. 15, 2012. (8 pages).

* cited by examiner

GLOVE HAVING REINFORCED FINGERTIPS

INCORPORATION BY REFERENCE TO ANY PRIORITY APPLICATIONS

Any and all applications for which a foreign or domestic priority claim is identified in the Application Data Sheet as filed with the present application are hereby incorporated by reference in their entirety.

BACKGROUND OF THE INVENTION

Field of the Invention

The present invention generally relates to utility gloves. More particularly, the present invention relates to such gloves having internally reinforced wear regions.

Description of the Related Art

Gloves are used for utility applications. For example, they can be used during raking of leaves or the like and other general lawn care activities.

Such gloves are prone to developing holes in the finger tips. For this reason, gloves have been introduced with reinforcement structures on the outsides of one or more of the fingers. The reinforcement structures can be rubber coated, for example. In some configurations, the reinforcement structures can be sewn to the outer surface of the finger or fingers.

It has been discovered, however, that these reinforcing structures themselves are prone to wear. For example, if secured by stitching, the stitches wear through and then the reinforcing structures delaminate from the underlying glove. In addition, even if adhered in position, the edge of the reinforcing structures can catch on edges during use and can peel away from the underlying glove.

SUMMARY OF THE INVENTION

Thus, an improved glove design is desired.

In some configurations, a glove can comprise at least one finger having a palm side and a back side. The at least one finger can have a bend region positioned so as to not overlie a distal interphalangeal joint of the user. A segment can be secured to an inner surface of the palm side of the at least one figure. The segment can be sized, shaped and configured so as to not overlap the bend region.

In some such configurations, the glove comprises a thumb having a palm side and a back side. The thumb can have a bend region positioned so as to not overlie a distal interphalangeal joint of the user. Another segment can be secured to an inner surface of the palm side of the thumb and the segment can be size, shaped and positioned so as to not overlap the bend region.

In some such configurations, the glove comprises four fingers and each finger has a segment secured to an inner surface of the palm side and not overlapping the bend region.

In some such configurations, the segment and the palm side of the finger are formed of the same material.

In some such configurations, the segment and the palm side of the finger are formed from different materials.

In some such configurations, the materials forming the segment and the palm side of the finger share at least one of an abrasion resistance, bend resistance, shear resistance, stretch damping, stretch limit, fold limit, density, and porosity.

In some such configurations, the segment is adhered to the inner surface of the palm side of the at least one finger by glue that extends to at least the edge of the segment closest to the bend region.

In some such configurations, the segment has an edge that is spaced from an edge of the palm side of the at least one finger such that a gap exists between the edge of the segment and the edge of the palm side of the at least one finger.

In some such configurations, the gap is between 1 mm and 2 mm when the glove is sewn.

In some such configurations, the back side comprises a first layer and a second layer secured to the first layer such that the second layer overlies at least a knuckle area.

In some such configurations, the back side of the glove and the back side of the thumb are formed of a stretchable material.

In some such configurations, the back side of the glove and the back side of the thumb are formed of a breathable material.

In some such configurations, the back side of the glove and the back side of the thumb are formed of a woven or knitted material.

In some such configurations, at least a portion of the finger and a portion of the thumb are covered with a second layer of material having an increased wear resistance.

In some such configurations, the second layer of material is stitched over top of a base layer of material of the back side of the glove.

In some such configurations, the palm side further comprises at least one pad portion.

In some configurations, a glove can comprise a palm side and a back side. Each of the palm side and the back side can comprise portions that extend upwardly and form at least a portion of a first finger portion, a second finger portion, a third finger portion, a fourth finger portion, and a thumb portion. Each of the first, second, third, and fourth finger portions can have a bend region positioned so as to not overlie a distal interphalangeal joint of the user. The glove can also comprise a segment secured to an inner surface of the palm side of the each of the finger portions and the thumb portion and not overlapping the bend region, wherein the segment and the palm side of the finger portions are formed of the same material.

In some such configurations, the palm side portions of the first, second, third, and fourth fingers are joined to the back side portions of the first, second, third, and fourth fingers by a boxed fourchette.

In some such configurations, fourchettes connect the back side and the palm side of the glove in regions between the first finger portion and the second finger portion, the second finger portion and the third finger portion, and the third finger portion and the fourth finger portion.

In some such configurations, at least a portion of the fourchettes is formed of a fabric material and a least a portion of the fourchettes is formed of a material with increased wear resistance.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures.

DETAILED DESCRIPTION OF THE PREFERRED EMBODIMENT

Figure 2:
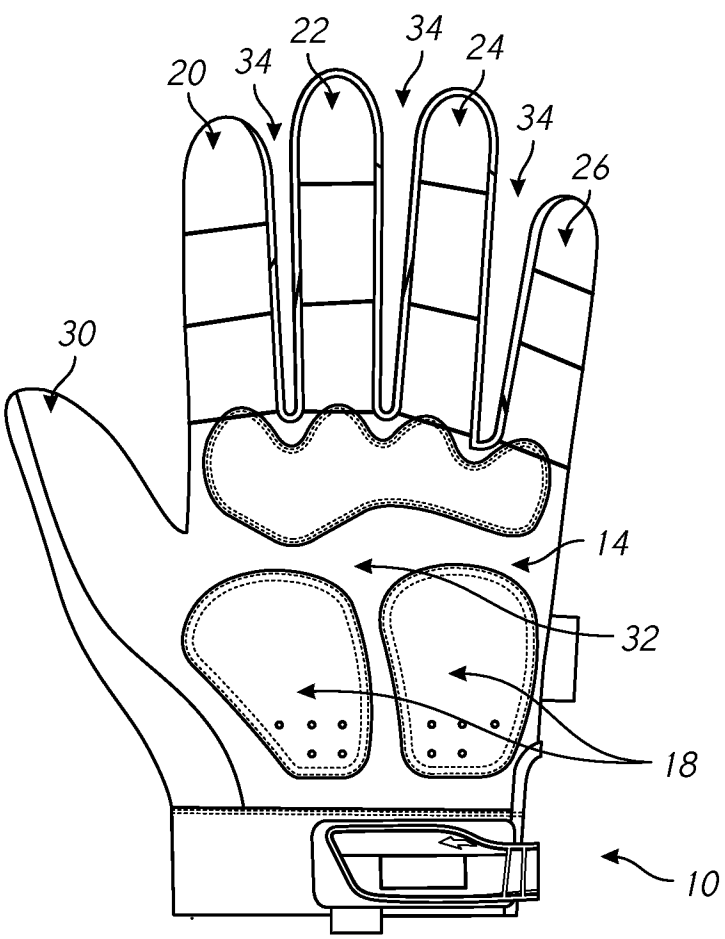
FIG. 2 is a palm view of the glove of FIG. 1.
Figure 1:
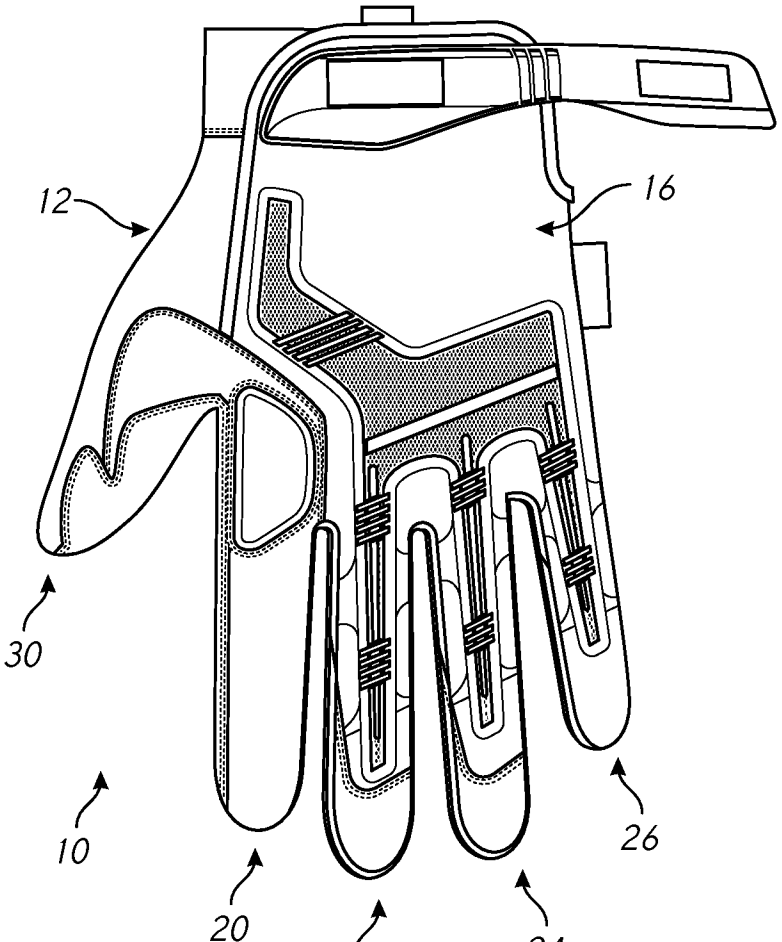
FIG. 1 is a dorsal view of a glove that is arranged and configured in accordance with certain features, aspects and advantages of the present invention.

With reference initially to FIGS. 1 and 2, a glove 10 is illustrated therein. The glove 10 can be formed as a pair of gloves with a left hand version and a right hand version.

The glove 10 generally comprises a back panel 12 that is configured to cover the back of the hand. The glove 10 also generally comprises a palm panel 14 that is configured to cover the palm of the hand. The back panel 12 and the palm panel 14 can be secured together in any suitable manner. In some configurations, the back panel 12 and the palm panel 14 can be formed of a single piece of material.

The illustrated back panel 12 comprises a main body portion 16. The main body portion 16 can extend over the back of the hand of the user. The illustrated back panel 12 also comprises portions that extend upwardly and form at least a portion of an index finger 20, a middle finger 22, a ring finger 24 and a pinkie finger 26. In some configurations, a separate panel can extend over at least a portion of a back of a thumb 30.

The back panel 12 and, where present, the separate back of a thumb panel can be formed of any suitable material. In some configurations, these components are formed of a stretchable material. In some configurations, these components are formed of a breathable material. In some configurations, these components are formed of a woven or knitted material. In some configurations, at least a portion of three of the four fingers 20, 22, 24 and at least a portion of the thumb 30 can receive a second layer of material. In some configurations, the second layer of material has an increased wear resistance. In some configurations, the second layer of material is simulated leather. In some configurations, the second layer is stitched over top of the base layers of material. In some configurations, the second layer includes a rubber or similar material to provide increased abrasion resistance. In some configurations, the index finger 20 is not covered with a second layer of material to allow the index finger 20 to be more easily manipulated when the glove is in use.

The illustrated palm panel 14 also comprises a main body portion 32. The main body portion 32 can extend over the palm of the hand of the user. The illustrated main body portion 32 also comprises portions that extend upwardly and form at least a portion of the index finger 20, the middle finger 22, the ring finger 24 and the pinkie finger 26. In the illustrated configuration, the thumb 30 is integrally formed with the main body portion 32 as are the other four fingers 20, 22, 24, 26. In some configurations, the palm panel 14 also comprises one or more pads 18. The pads 18 provide additional padding to the palm of the hand to absorb impact and vibration. In some configurations, the pads 18 can be joined to the main body portion 32 in any suitable manner, such as stitching, glue, or other adhesive means. In some configurations, the pads 18 may be integrally formed with the main body portion 32.

The palm portions of the fingers can be joined to the back of the hand portions in any suitable manner. In some configurations, the glove has a boxed fourchette configuration. In other words, fourchettes 34 can be used to connect the back of the hand and the palm portions in the regions between the index finger 20 and the middle finger 22, the middle finger 22 and the ring finger 24, and the ring finger 24 and the pinkie finger 26. In some configurations, at least a portion of the fourchettes 34 is formed of a fabric material and at least a portion of the fourchettes 34 is formed of a material with increased wear resistance, such as a simulated leather, for example but without limitation. In some configurations, the portions of the fourchettes 34 that are closest to the tips of the fingers are formed of the increased wear resistant material while the portions of the fourchettes 34 that are furthest from the tips of the fingers are formed of a less wear resistant material, such as a fabric, for example. In some configurations, the increased wear resistant material extends further downward along the side of each finger closest to the thumb compared to the opposing side of each finger.

Figure 3:
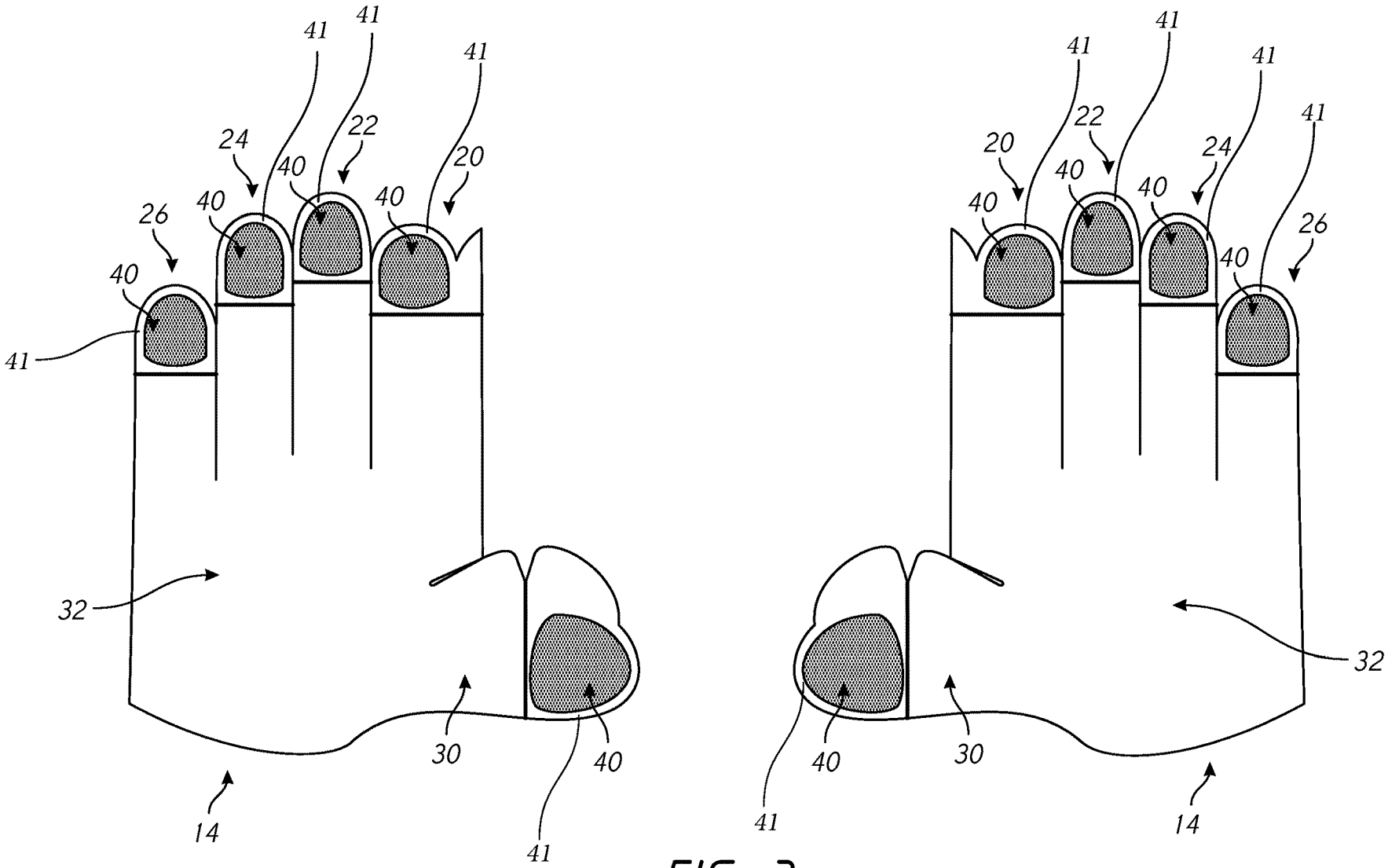
FIG. 3 is a plan view of a palm portion of two gloves illustrating finger pad reinforcements.

With reference now to FIG. 3, two palm panels 14 (one for the left hand and one for the right hand) are illustrated. As illustrated in FIG. 2, each of the fingers 20, 22, 24, 26 has three bend regions that correspond to the knuckles of the user. The illustrated glove does not include any features that necessary cause these bend regions; the bend regions are just shown for the convenience of the reader. Returning to FIG. 3, the distal most bend region (i.e., the joint between the distal phalanx and the middle phalanx, otherwise known as the distal interphalangeal joint) is reproduced on the drawings of FIG. 3.

As illustrated, segments 40 are illustrated. The segments 40 can be positioned on one or more of the fingers 20, 22, 24, 26 and the thumb 30. In some configurations, the segments 40 are positioned only on the index finger 20 and the thumb 30. In some configurations, the segments 40 are positioned on two or more of the finger 20, 22, 24, 26. In some configurations, the segments 40 are positioned on all of the fingers 20, 22, 24, 26 and the thumb 30.

The segments 40 can be positioned such that they do not extend downward from the tip of the associated finger 20, 22, 24, 26 or thumb 30 beyond the knuckle of that finger or thumb. In some configurations, the segments 40 are positioned only on the palm panel 14. In some configurations, the segments 40 have an edge that is spaced from an edge of the palm panel 14 such that a gap exists between the edge of the segments 40 and the edge of the palm panel 14. In some configurations, the gap is between 1 mm and 2 mm when the glove is sewn such that the gap is between the edge of the segments and the seam of the finger.

The segments 40 can be formed of the same material as the underlying portions of the associated finger. In other words, the segments 40 selectively double the thickness of the material in the fingertip pad regions. The segments 40 and the palm panel 14 can be formed of the same material. The segments 40 and the palm panel 14 can be formed of a simulated leather material, for example but without limitation. In some configurations, the segments 40 and the underlying portions of the fingers 20, 22, 24, 26 and thumb 30 can be formed of distinct materials from each other so long as one or more of the following are the same: abrasion resistance, stretch resistance, bend resistance, shear resistance, stretch damping, stretch limit, fold limit, density and porosity.

The segments 40 can be secured to the inside surface of the palm panel 14 or any other underlying surface of the fingers on the palm side. The segments 40 can be secured in any suitable manner. In some configurations, the segments 40 are adhered to the inside surface of the palm panel 14 or any other underlying surface on the palm side. For example, glue can be used for bonding the two pieces together. In some configurations, the glue extends to the complete edge of the segment 40. In some configuration, the glue extends to at least the edge closest to the bend region. By extending the glue to the edge closest to the base of the finger, the segment 40 is less likely to delaminate from the inside surface of the glove due to insertion of the user's finger into the glove.

Advantageously, by securing the segments 40 to the fingers and/or thumb on the inside of the glove, the edges of the segments 40 are less likely to catch on surfaces during use, which reduces the likelihood of the segments 40 delaminating from the underlying glove. For example, if the segments 40 were positioned on the outside surface, during use of the glove, the segments 40 would likely peel away. If a thread was used to secure the segments on an outside surface, the threads would wear away first, and then the segments would separate from the outside surface of the glove.

In addition, by securing the segments 40 in just the fingertip pad regions, the flexibility of the fingers of the gloves is not impacted while providing extended wear performance in the regions most susceptible to wearing through and receiving holes. By terminating the extent of the segments 40 above the knuckles of the user (i.e., the bend regions), flexibility in a reinforced glove is improved. Further, a seamless wear point is provided by the illustrated configuration and, if the user wears through the outer layer, the segments provide a second layer as reinforcement.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A glove comprising four fingers, said four fingers each having a palm side and a back side, said four fingers each having a bend region positioned along the fingers, a segment secured to an inner surface of the palm side of the fingers and not overlapping the bend region, wherein the segment has an edge that is spaced from an edge of the palm side of the fingers such that a gap exists between the edge of the segment and the edge of the palm side of the fingers, wherein when worn by a user, said bend region does not overlie a distal interphalangeal joint of the user, and further wherein the back side comprises a first layer and a second layer secured to the first layer such that the second layer overlies at least a knuckle area of the glove and does not cover the index finger of the user, and wherein the glove comprises a thumb having a palm side and a back side, the thumb having a bend region, and another segment secured to an inner surface of the palm side of the thumb and not overlapping the bend region, wherein the segments are adhered to the inner surface of the palm side of said fingers by glue that extends to at least an edge of the segment closest to the bend region, and wherein the back side of the glove and the back side of the thumb are formed of a stretchable material, and further wherein at least a portion of three of the said four fingers and a portion of the thumb are covered with a second layer of material having an increased wear resistance, wherein the second layer of material is stitched over top of a base layer of material of the back side of the glove.

2. The glove of claim 1, wherein the segment and the palm side of at least one of said four fingers are formed from different materials.

3. The glove of claim 2, wherein the materials forming the segment and the palm side of at least one of said four fingers share at least one of an abrasion resistance, bend resistance, shear resistance, stretch damping, stretch limit, fold limit, density, and porosity.

4. The glove of claim 1, wherein the back side of the glove and the back side of the thumb are formed of a breathable material.

5. The glove of claim 1, wherein the back side of the glove and the back side of the thumb are formed of a woven or knitted material.

6. The glove of claim 1, wherein the palm side further comprises at least one pad portion.

7. A glove comprising a palm side and a back side, each of the palm side and the back side comprising a first finger portion, a second finger portion, a third finger portion, a fourth finger portion, and a thumb portion, each of the first, second, third, and fourth finger portions having a bend region, and a segment secured to an inner surface of the palm side of the each of the finger portions and the thumb portion and not overlapping the bend region, wherein the segment and the palm side of the finger portions are formed of the same material, wherein the palm side portions of the first, second, third, and fourth fingers are joined to the back side portions of the first, second, third, and fourth fingers by a boxed fourchette, wherein when worn by a user, said bend region does not overlie a distal interphalangeal joint of the user, and further wherein the back side comprises a first layer and a second layer secured to the first layer such that the second layer overlies at least a knuckle area of the glove and does not cover the index finger of the user, and wherein the segment is secured to the inner surface of the palm side of each of the finger portions by glue that extends to at least an edge of the segment closest to the bend region.

8. The glove of claim 7, wherein said fourchettes connect the back side and the palm side of the glove in regions between the first finger portion and the second finger portion, the second finger portion and the third finger portion, and the third finger portion and the fourth finger portion.

9. The glove of claim 8, wherein at least a portion of the fourchettes is formed of a fabric material and a least a portion of the fourchettes is formed of a material with increased wear resistance.

* * * * *